United States Patent [19]

Sassier

[11] Patent Number: 4,697,643

[45] Date of Patent: Oct. 6, 1987

[54] TEMPERATURE-COMPENSATED PRESSURE CONTROLLER, OPERATIONALLY RELIABLE EXTINGUISHER PROVIDED WITH SUCH A PRESSURE CONTROLLER AND PROCESS FOR FILLING SUCH A PRESSURE CONTROLLER

[75] Inventor: Pierre Sassier, Bercheres Sur Vesgre, France

[73] Assignee: Thomson CSF, Paris, France

[21] Appl. No.: 853,922

[22] Filed: Apr. 21, 1986

[30] Foreign Application Priority Data

Mar. 7, 1986 [FR] France ..... 86 4004924

[51] Int. Cl.[4] ..... A62C 23/08; H01H 35/32

[52] U.S. Cl. ..... 169/23; 73/706; 73/708; 73/717; 116/70; 169/75; 200/81.4; 200/83 D; 340/605; 340/626

[58] Field of Search ..... 169/23, 75; 340/605, 340/626; 116/70; 73/706, 708, 717; 200/81.4, 81.5, 83 D

[56] References Cited

U.S. PATENT DOCUMENTS

| | | | |
|---|---|---|---|
| 3,576,412 | 12/1968 | Julien-Davin . | |
| 3,735,376 | 5/1973 | Kramer et al. | 169/23 X |
| 3,757,292 | 9/1973 | Sato et al. | 200/81.4 X |
| 3,946,175 | 3/1976 | Sitabkhan | 340/626 X |
| 4,143,545 | 3/1979 | Sitabkhan | 73/708 X |
| 4,289,207 | 9/1981 | Wernert . | |
| 4,297,687 | 10/1981 | Fuzzel . | |

FOREIGN PATENT DOCUMENTS 1028886 4/1952 Fed. Rep. of Germany .

*Primary Examiner*—Jeffrey V. Nase

*Attorney, Agent, or Firm*—Cushman, Darby & Cushman

[57] ABSTRACT

Extinguisher provided with a temperature compensated pressure controller, comprising a propelling agent and an extinguishing agent under gaseous form, wherein it comprises a sealed chamber filled with a mixture having a thermodynamic characteristic similar to that of the two agents in the extinguisher, a system for measuring the differential pressure exisiting between the inside of the sealed chamber and the chamber per se and a device actuated by the system for measuring the differential pressure and generating an alarm signal when the differential pressure exceeds a threshold value.

10 Claims, 1 Drawing Figure

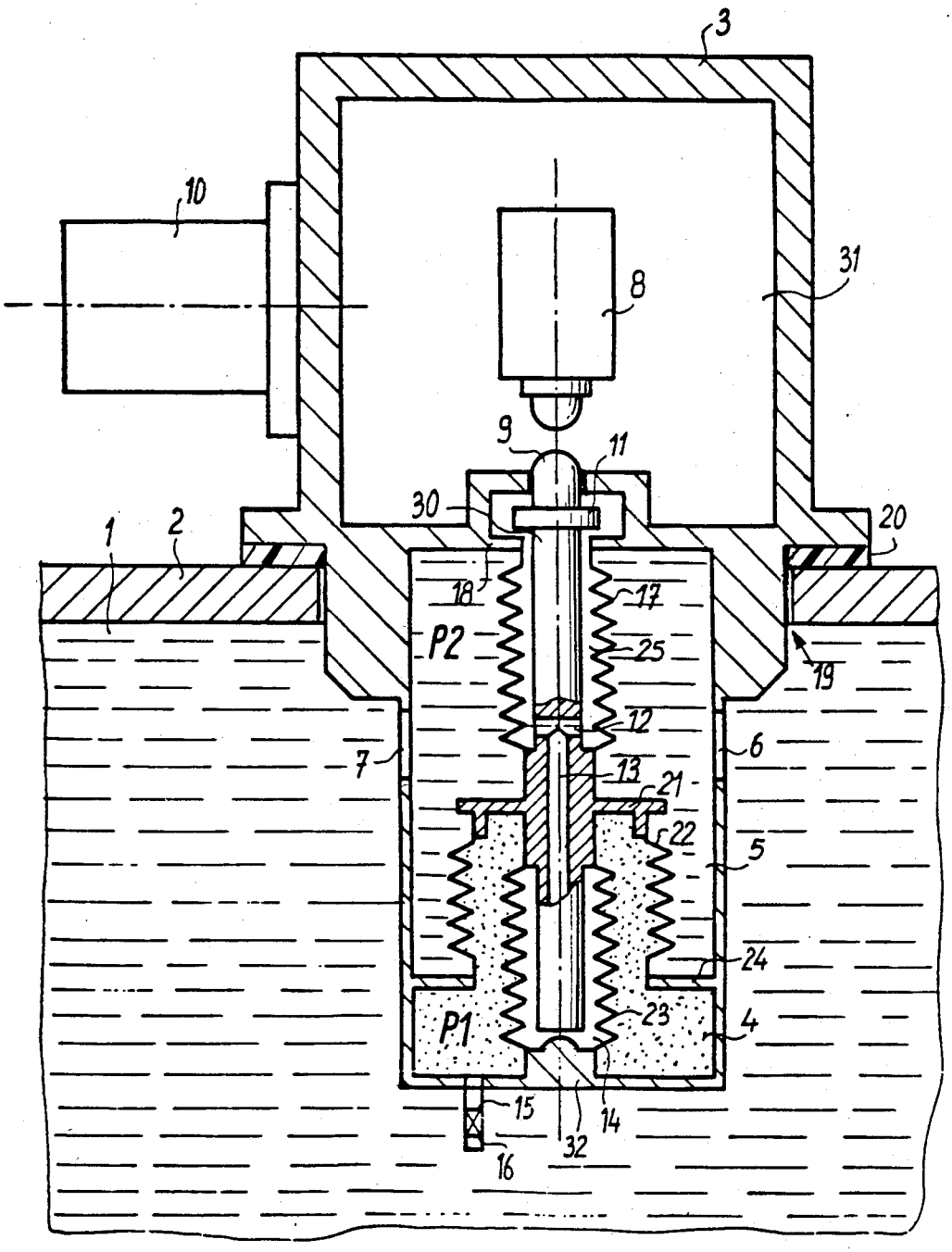
3
10
31
8
9
11
30
20
1
2
18
17
P2
25
19
12
7
6
13
21
22
5
24
P1
23
4
15
14
32
16

TEMPERATURE-COMPENSATED PRESSURE CONTROLLER, OPERATIONALLY RELIABLE EXTINGUISHER PROVIDED WITH SUCH A PRESSURE CONTROLLER AND PROCESS FOR FILLING SUCH A PRESSURE CONTROLLER

BACKGROUND OF THE INVENTION

Field of the Invention

The present invention concerns a temperature-compensated pressure controller and an operationally reliable extinguisher as well as a process for filling a pressure controller according to the invention. Said pressure controller is intended to be utilized in fighting fires by being adapted to rapid discharge fire-fighting appliances.

On board, aircraft fire-fighting equipment is only ever used once and almost never throughout an entire fleet of planes. Therefore, there is statistically very little chance of the extinguisher ever being used. However, when it is required, this extinguisher should operate as well five or ten years after its manufacture as at its date of manufacture. Current methods for manufacturing extinguishers provoke risks of low rate leakage or bleeding which consequently render the appliances unserviceable or ineffective after being put into service for a certain period of time. In order to overcome this drawback, the prior art presents a solution that consists of permanently measuring the internal pressure of the extinguisher and in comparing it with a threshold pressure. Once the measurement drops below the limit pressure value, a microswitch mounted on a pressure pick-up supplies an alarm signal that is transmitted to the safety unit of the aircraft.

However, since the extinguisher is subjected to extremely variable temperatures, depending upon the site, time and altitude, the pressure prevailing inside the extinguisher also varies according to a complex thermodynamic law. Furthermore, these known extinguishers comprise two gaseous agents:

a propelling agent such as nitrogen;

a fire-fighting agent such a halon.

However, these gases are generally miscible and account must be made for their eventual interactions.

The present invention offers a solution to these problems. It also provides increased simplicity of means, thereby rendering it less expensive to operate than conventional appliances. In fact, the present invention concerns a temperature-compensated pressure controller. The pressure controller comprises a first chamber, filled with a reference mixture having a thermodynamic characteristic similar to that of a mixture filling an enclosure to be controlled. It also concerns an extinguisher fitted with a safety device, comprising a propelling agent and an extinguishing agent in a gaseous form, characterized in that it comprises a sealed chamber filled with a mixture having a thermodynamic characteristic similar to that of the two agents in the extinguisher, a system measuring the differential pressure existing between the inside of the sealed chamber and the inside of the extinguisher per se and device actuated by the system for measuring the differential pressure and generating an alarm signal when the differential pressure exceeds a threshold value. The invention also concerns a process for filling pressure controllers according to the invention. The process consists in filling a tank with the reference mixture then in producing a primary vaccum upon the pressure controllers to be filled. The whole is introduced into a thermostat at a temperature higher than the critical temperature of the reference mixture. At equilibrium, the filling tank is connected to the pressure controllers to be filled. When equilibrium has been achieved, the pressure controllers are sealed and brough back to ambient temperature.

BRIEF DESCRIPTION OF THE DRAWINGS

Other objects, features and advantages of the invention will become more apparent from reading the following description and appended drawing which represents an embodiment of an extinguisher according to the present invention.

DETAILED DESCRIPTION OF THE PREFERRED EMBODIMENT OF THE PRESENT INVENTION

The figure represents the single part 1 of the extinguisher which carries the device ensuring the operating safety of the extinguisher. The shell 2 of the extinguisher comprises a bore through which a housing 3 is passed. The housing 3 comprises a chamber 4 filled with a gaseous mixture of which the thermodynamic behavior in pressure and temperature is similar to that contained in the extinguished per se. The gaseous mixture in the chamber 4 must thus present a pressure-temperature characteristic identical to that of the gases contained in the extinguisher. The two curves can be identical or obtained through simple constant translation. In the present embodiment, the mixture of chamber 4 is identical to that contained in the extinguisher.

One advantage of chamber 4 is that it is perfectly sealed. The deficiencies of a classical extinguisher are often provoked by the manufacturing process itself. In fact, high-pressure extinguishers often comprise tightnesses obtained by utilizing a flat joint. Very low leakages at this level can result after a five-year period in pressure drops of about ten per cent which are incompatible with safety standards. Chamber 4 is constructed in such a way as to prevent these leakages.

In the preferred embodiment, the chamber 4 is a part of housing 3. This comprises a volume 5 which communicates through orifices 6,7 with the inside of the extinguisher. The volume 5 is adjacent to the chamber 4. The chamber 4 comprises a wall 21, 24 adjacent to the volume 5 and thus supports on the ond side a pressure P1 in the chamber 4 and on the other a pressure P2 in the volume 5 and thus in the extinguisher 1.

In order to measure the differential pressure P1-P2, the wall 21, 24 comprises two parts, one 24 of which is fixed relative to the volume, and the other 21 of which is movable. The movable part 21 is connected to the fixed part 24 by bellows 22, for example hydroformed in stainless steel of the Calorstat type, which act for both sealing and as calibration spring.

It is thus apparent that the shaft axis 30 integral with the movable wall 21 is displaced by a quantity which is in fucntion of the pressure difference P2-P1 between the two compartments 4, 5. Since these mixtures have the same thermodynamic behavior, this pressure difference does not depend upon the temperature and the safety device is thus correctly temperature compensated.

The shaft 30 is preferably manufactured in a single piece with the movable wall 21 so as to prevent sealing problems. It also carries a finger 9 mounted an the end of the shaft 30 upon an abutment 11. The finger 9 passes through an orifice in a third compartment 31 of the housing 3. This compartment contains a microswitch 8 which is only activated for a stoke or travel of the finger 9 corresponding to a critical pressure difference.

In this hypothesis, it is known that the leakages of the extinguisher render it unserviceable and a generator 10 transmits a signal to a safety unit mounted for example in the aircraft.

In one embodiment, the microswitch 8 has to operate in an environment close to that of free atmosphere, i.e. the atmosphere outside the extinguisher.

Since the shaft 30 passes through the housing 3 at the separation between the volume to the second compartment and the third compartment 31, sealing means are required to be disposed between these two compartments. Stainless steel bellows 17 are thus disposed which provide a chamber 25 communicating with the third compartment 31, the chamber 25 surrounding the shaft 30 and protecting it against the contents of the extinguisher 1.

The shaft 30 transmits the position of the plate 21. This position is subsequent to the equilibrium of the forces between the pressure applied on the efficient sections of the bellows 17, 22, 23 and the stiffness of these same bellows.

Bellows 17 and 23 are subjected to the same internal pressure (pressure in the chamber 31) through the passage section 12 and 13. Bellows 17 is rigidly associated to part 18. Bellows 23 is rigidly associated to part 32. The parts 18 and 23 are rigidly associated to one another. Furthermore, since the efficient sctions of the bellows 17 and 23 have the same value, the fluctuations in pressure in chamber 31 have no effect upon the position of the plate 21.

If the extinguisher presents a low rate leakage between the chamber P2 to the pressure of the extinguisher and the chamber 25 to the external pressure, the shaft 30 rises sufficiently to actuate switch 8. In one embodiment, the case where the bellows 23 presents a leakage between the chambers 14 and 4 has also been foreseen. A second microswitch is disposed, for example on the abutment 32, in order to detect the downward displacement of the shaft 30 to the leakage of the bellows 23.

At the interface 19 of the housing and the envelope 2 of the extinguisher 1, the safety device is fixed and a flat sealing ring 20 is disposed so as to ensure tightness.

In the case where the envelope 2 is subjected to very high pressure receiving tests, it is not necessary to cause the safety device to undergo such efforts. Thus, the interface 19 is constituted by a threading in order to render the safety device detachable. The orifice is again closed during the test by a corresponding threaded stopper.

In one embodiment, the filling of the chamber 4 is ensured by a tube 15. In one embodiment, the filling of both extinguisher 1 and chamber 4 ensure the same thermodynamic mixtures (same temperature pressure variations). Once filling has been completed, the tube is welded in 16.

In particular, the characteristic of the invention which causes the pressure for filling the enclosure to be controlled to be equal that of the pressure controller prevents the risks of leakage at closing 16.

The filling of the pressure controller prior to its installation upon the enclosure to be controlled raises a delicate problem. In fact, the mixture in the chamber 4 must have a mixture ratio and a pressure that are perfectly adapted and thus determined by the characteristics of the mixture in the enclosure to be controlled. The invention thus equally concerns a process for filling a temperature compensated pressure controller according to the invention. According to the process, a filling tank is first of all loaded from primary vacuum to a given mass of mixture which is defined so as to obtain upon completion of the filling operation the mixture ratio and the thermodynamic conditions desired. At least one pressure controller is put under primary vacuum and connected to an inlet cock (initially closed) issuing into the filling tank. The whole is placed within a climatic chamber brought to a higher temperature equal to the critical temperature of the mixture. Once the thermodynamic equilibrium has been reached, the inlet cock to the tank is opened in order to fill the pressure controllers. Once the thermodynamic equilibrium has again been reached, the inlet cock is again closed and tube 15 filling each pressure controller is sealed, thereby causing the drop to ambient temperature. The cycle is determined in such a way that the molar composition and the pressure in the pressure controller at the end of the filling operation correspond to the desired values.

The present invention is also adapted to be used in the surveillance of capacities for storing pressurized gas, both for installations transported on aerial, spatial or land craft, as well as fixed installations such as storage tanks for refineries. The present invention is particularly adapted to bottles for inflating pneumatic life-saving dinghies transported aboard such craft.

In another embodiment, the pressure controller is constituted around a Bourdon tube immersed in the capacity to be surveyed, the capacity of which is filled with a reference mixture. The tube has a calibrated stiffness and is movable so as to activate an actuating lever of a microswitch analog to the switch 8 so as to generate an alarm signal warning the safety unit that the controlled enclosure has undergone a pressure drop due to leakage. This pressure drop is not due to a variation of the external atmosphere since the pressure controller is temperature-compensated. With this purpose, the pressure controller always carries an equilibrating chamber intended to set off, i.e. to cancel, the variations in pressure of the external atmosphere of the pressure controller. In the case of a Bourdon tube pressure controller, the data relative to the pressure drop is transmitted to a microswitch inside the capacity to be surveyed which is subject to external pressure conditions. The putting in place of an equilibrating system based upon the principle of that represented in the drawing suppresses the influence of external pressures upon the system.

In another embodiment, the microswitch 8 is replaced by an electric device that supplies a signal in fucntion of the position of the movable device 30, i.e. the pressures acting upon the parts of the pressure controller associated to the movable device 30. The derived signal is calibrated and permanently furnishes the value of the controlled differential pressure.

I claim:

1. A temperature compensated pressure controller for a fire extinguisher or other pressurized vessel comprising:

a reference pressure chamber means for holding a predetermined amount of compressible fluid;

a vessel pressure chamber means which is adapted to be in communication with the interior of said fire extinguisher or pressurized vessel;

movable wall means which is mounted to move when the pressure in said reference chamber means differs from the pressure in said vessel chamber means, said movable wall means having an elongate finger integral therewith;

an atmospheric pressure chamber means which is adapted to be communication with the atmosphere;

means for biasing said movable wall means to a predetermined position, said biasing means further acting to separate said elongate finger from said vessel chamber means and to allow communication space defined thereby around said finger with said atmosphere chamber means; and electric means for producing a signal responsive to displacement of said finger, whereby loss of pressure in said fire extinguisher or pressurized vessel may be detected regardless of the ambient atmospheric pressure.

2. A pressure controller according to claim 1, wherein said biasing means comprises at least one bellows which defines a wall for said reference chamber means.

3. Pressure controller according to claim 1, wherein the reference chamber means is limited by a wall that is deformable at least in the direction of displacement of the movable device and in contact with the pressure of the capacity to be controlled.

4. Pressure controller according to claim 3, wherein the deformable wall is constituted by a Bourdon tube, one end of which is connected to the movable wall means.

5. Pressure controller according to claim 3, wherein the deformable wall is constituted by bellows associated to the movable wall means.

6. A fire extinguisher of type having a propelling agent and an extinguishing agent stored in an interior chamber thereof, having a temperature compensated pressure controller comprising a reference pressure chamber means for holding a predetermined amount of compressible fluid;

a vessel pressure chamber means which is in communication with the interior of said fire extinguisher;

movable wall means which is mounted to move when the pressure in said reference chamber means differs from the pressure in said vessel chamber means, said movable wall means having an elongate finger integral therewith;

an atmospheric pressure chamber means which is in communication with the atmosphere;

means for biasing said movable wall means to a predetermined position, said biasing means further acting to separate said elongate finger from said vessel chamber means and to communicate a space around said finger with said atmospheric chamber means; and electric means for producing a signal responsive to displacement of said finger, whereby loss of pressure in said fire extinguisher or pressurized vessel may be detected regardless of the ambient atmospheric pressure.

7. Extinguisher according to claim 6, wherein the elongate finger is mounted upon a shaft with an abutment in order to limit its stroke, the shaft being an extension of the movable wall means.

8. Extinguisher according to claim 7, wherein the electric means is disposed in said atmospheric chamber means and wherein the shaft passes through an orifice at the separation between the vessel chamber means and the atmospheric chamber means.

9. Extinguisher according to claim 6, wherein the reference chamber means is filled with the same mixture of two gaseous agents as the extinguisher.

10. Extinguisher according to claim 9, wherein the interface between a housing of the controller and a wall of the extinguisher is constituted by a threading in order to render removable the pressure controller.

* * * * *